US007284561B2

(12) United States Patent
Byrne et al.

(10) Patent No.: US 7,284,561 B2
(45) Date of Patent: Oct. 23, 2007

(54) DETERGENT DISPENSER FOR A WASHER SYSTEM

(75) Inventors: Robert M. Byrne, Lima, OH (US); Kurt Hafeken, Sr., Elida, OH (US)

(73) Assignee: American Trim, L.L.C., Lima, OH (US)

( * ) Notice: Subject to any disclaimer, the term of this patent is extended or adjusted under 35 U.S.C. 154(b) by 255 days.

(21) Appl. No.: 10/995,072

(22) Filed: Nov. 22, 2004

(65) Prior Publication Data

US 2006/0059958 A1 Mar. 23, 2006

Related U.S. Application Data

(60) Provisional application No. 60/610,848, filed on Sep. 17, 2004.

(51) Int. Cl.
*B08B 3/02* (2006.01)

(52) U.S. Cl. ..... 134/94.2; 134/94.1; 68/17 R

(58) Field of Classification Search ..... 134/94.1, 134/99.2; 68/17 R; 222/651, 425
See application file for complete search history.

(56) References Cited

U.S. PATENT DOCUMENTS

| | | | | |
|---|---|---|---|---|
| 2,254,269 | A * | 9/1941 | Clark et al. | 134/57 D |
| 2,585,838 | A * | 2/1952 | Ransohoff | 134/58 R |
| 2,846,776 | A * | 8/1958 | Clark | 34/547 |
| 2,864,538 | A * | 12/1958 | Rasmussen | 222/453 |
| 3,102,664 | A * | 9/1963 | Lines | 222/651 |
| 3,207,373 | A * | 9/1965 | Dannenmann | 222/651 |
| 3,498,304 | A * | 3/1970 | Rumbaugh | 134/58 D |
| 3,827,600 | A * | 8/1974 | Janke | 222/651 |
| 3,828,975 | A * | 8/1974 | Robandt et al. | 222/651 |
| 4,763,676 | A | 8/1988 | Mizuno | |
| 4,936,331 | A | 6/1990 | Sundberg | |
| 4,974,750 | A * | 12/1990 | Welch | 222/129 |
| 5,413,259 | A * | 5/1995 | Cerruti et al. | 222/636 |
| 5,694,794 | A * | 12/1997 | Jerg et al. | 68/17 R |
| 5,839,454 | A | 11/1998 | Matz | |
| 5,870,906 | A | 2/1999 | Denisar | |
| 6,138,693 | A * | 10/2000 | Matz | 134/57 D |
| 7,047,987 | B2 * | 5/2006 | Cerruti et al. | 134/58 D |
| 2005/0023290 | A1 * | 2/2005 | Kon et al. | 222/39 |

FOREIGN PATENT DOCUMENTS

| | | | |
|---|---|---|---|
| DE | 39 03 636 | * | 8/1990 |
| DE | 41 34 786 | * | 7/1992 |
| GB | 2 288 191 | * | 10/1995 |
| JP | 1-164396 | * | 6/1989 |

OTHER PUBLICATIONS

European Patent Office 0 430 366 Nov. 1990.*
European Patent Office 0 461 870 Jun. 1991.*
European Patent Office 1 319 360 Dec. 2001.*
U.S. Appl. No. 10/985,337, filed Nov. 10, 2004 entitled "Behind-Sink Dishwasher".

* cited by examiner

*Primary Examiner*—Frankie L. Stinson
(74) *Attorney, Agent, or Firm*—Rankin, Hill, Porter & Clark LLP

(57) ABSTRACT

A detergent dispenser system is disclosed in which a dispensing valve is provided for fluidly connecting to a detergent supply container. A receptacle is connected to the dispensing valve for receiving a predetermined quantity of detergent from the detergent supply container. A motor is provided for displacing the receptacle between a fill position, connected to the dispensing valve, and a dispensing position, where the detergent is dispensed from the receptacle.

3 Claims, 4 Drawing Sheets

DETERGENT DISPENSER FOR A WASHER SYSTEM

BACKGROUND OF THE INVENTION

1. Field of Invention

The present invention relates to detergent dispensers and, more particularly, to detergent dispensers of the type for dispensing detergent into washer system appliances such as dishwashers and the like.

2. Description of Related Art

In a typical dishwasher appliance, detergent is measured out manually and placed into the washer each time the washer is operated. The manual dispensing of detergent is not a precise or measured process. It may happen that not enough detergent is added, in which case the dishware may not be adequately cleaned. Alternatively, too much detergent may be added, in which case a residue may cling to the dishware after the wash cycle. Furthermore, the use of excessive amounts of detergent results in waste and added cost.

It has been known to use a side-mounted detergent dispenser (typically installed in the door of the dishwasher) to enable appliance users to measure proper amounts of detergent for each wash cycle. However, these dispensers are simply fixed containers or cavities that must be manually filled by the appliance user prior to each wash cycle. One of the problems with this type of detergent dispenser is that if the detergent is not completely washed out of the dispenser cavity during the wash cycle, the remaining detergent will dry and form an accumulating residue. This residue results in faulty detergent measurements and requires frequent cleaning of the dispenser. In this way, such dispensers of this type are actually a burden on the users, and do not improve efficiency.

BRIEF SUMMARY OF THE INVENTION

The difficulties and drawbacks associated with conventional detergent dispenser systems are overcome by the present detergent dispenser system in which a dispensing valve is provided for fluidly connecting to a detergent supply container. A receptacle is connected to the dispensing valve for receiving a predetermined quantity of detergent from the detergent supply container. A motor is provided for displacing the receptacle between a fill position, connected to the dispensing valve, and a dispensing position, where the detergent is dispensed from the receptacle into the washer.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
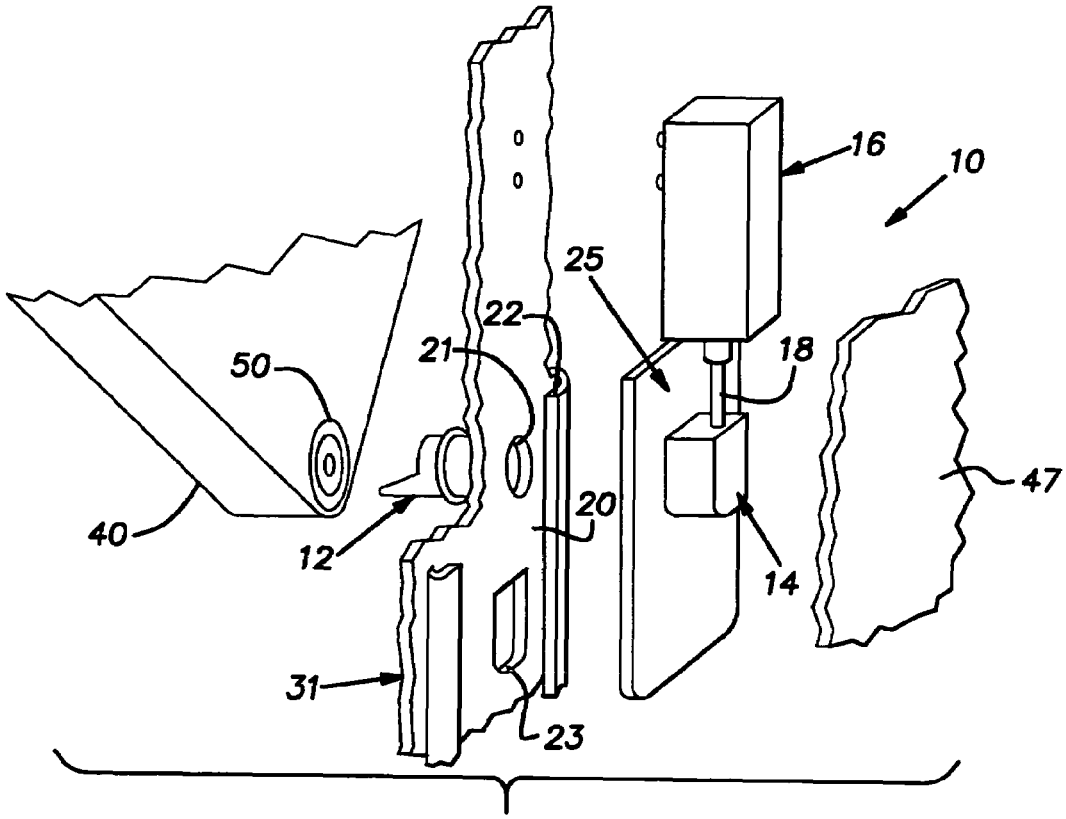
FIG. 1 is an exploded perspective view of a detergent dispenser in accordance with a preferred embodiment of the invention.
Figure 2A:
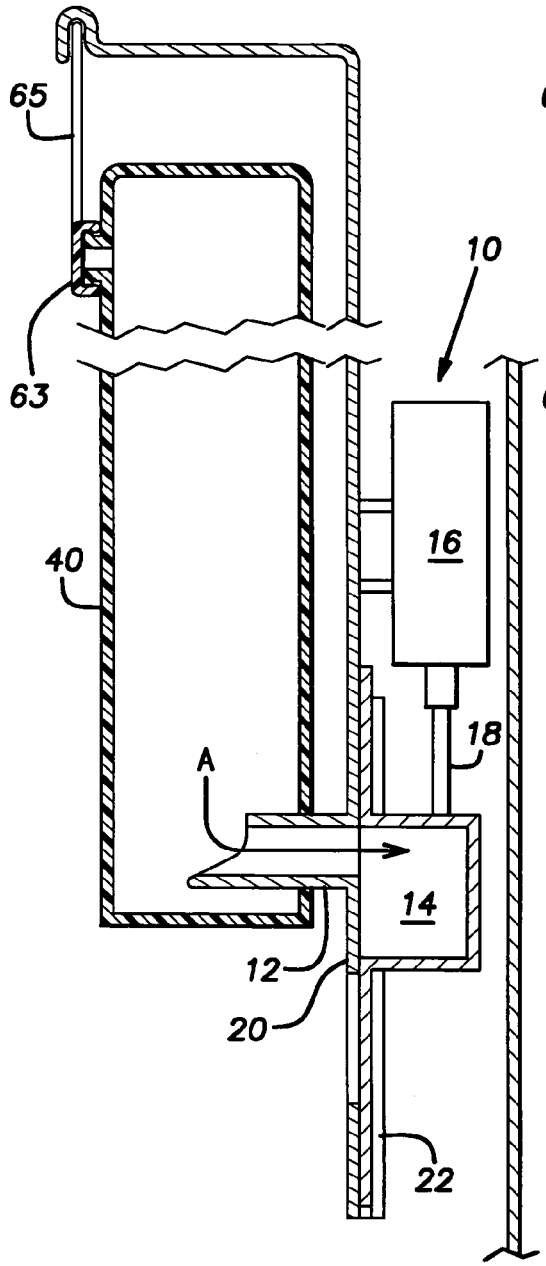
FIGS. 2A and 2B are side-sectional views of the assembled detergent dispenser shown in FIG. 1 showing the receptacle in a fill position and a dispensing position, respectively.
Figure 2B:
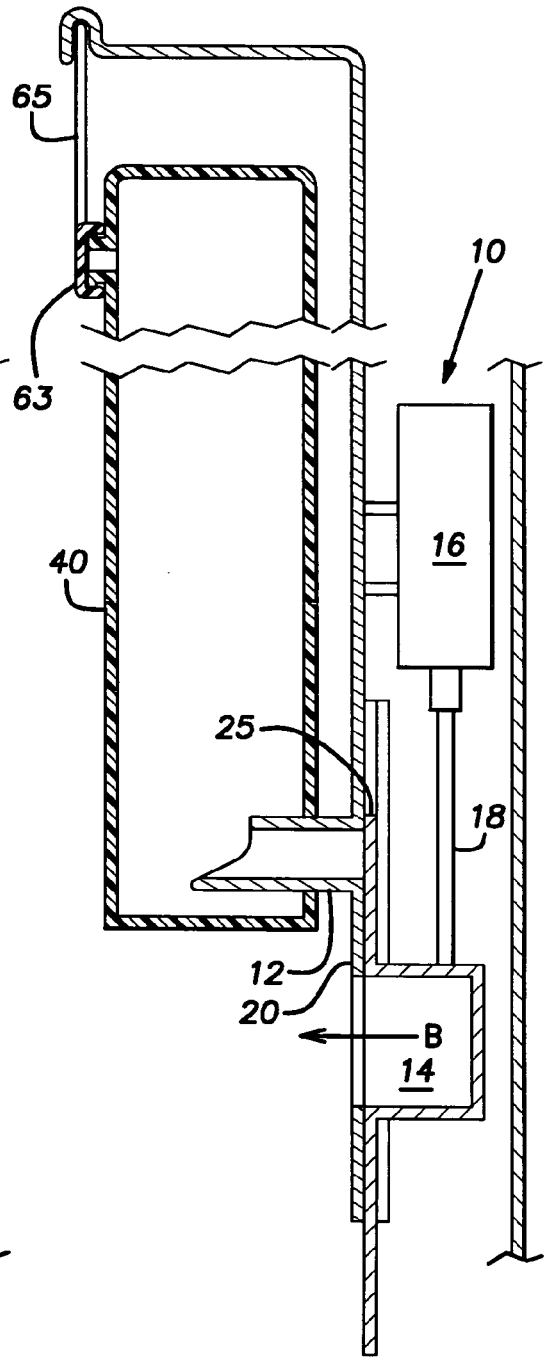

Particular reference is now made to the drawing figures, where it is appreciated that like reference numerals refer to like elements. FIGS. 1, 2A and 2B show a detergent dispensing system 10 according to the invention comprising a detergent supply container 40, a dispensing valve 12 having a hollow interior that defines a flow passage for detergent, and a receptacle 14 for receiving a predetermined amount of detergent from the detergent supply container 40 through the dispensing valve 12.

A motor 16 moves the receptacle 14 between a fill position (shown in FIG. 2A), wherein the receptacle 14 is fluidly connected to detergent supply container 40 by means of the dispensing valve 12, and a dispensing position, wherein detergent is dispensed from the receptacle 14 into the washer system, as described in greater detail below. The motor includes a piston 18 connected to the receptacle 14 such that movement of receptacle 14 is effected by extension and retraction of the piston 18.

In the preferred embodiment, the motor 16 that moves or displaces the receptacle 14 between the fill position and the dispensing position is a wax motor. Wax motors, such as are available from Eltek S.p.a. of Italy, are robust and responsive in a variety of different environments, including moist washer system environments. Wax motors, which are also sometimes referred to as thermoactuator devices, generally consist of a housing or body that incorporates a heat sensitive substance that expands upon being heated. Expansion of the heat sensitive substance (caused by activation of an electronic thermo-resistive heating device) gradually pushes a piston 18 out of the housing or body. Deactivation of the electronic thermo-resistive heating device causes the heat sensitive substance to cool and contract, which causes the piston 18 to withdraw back into the housing or body. A spring may be used to assist pushing the piston 18 back into the housing or body. Wax motors provide greater safety for moist-environment applications since they do not require high electrical currents as with solenoid-based motors. However, it is appreciated that any suitable motor could be used without departing from the invention.

In the preferred embodiment, the detergent is a liquid detergent and the receptacle 14 is configured to retain about one fluid ounce of liquid detergent. Throughout the instant specification and in the appended claims, the term "liquid detergent" refers to all conventional dishwasher detergents that are not dry solids (e.g., powder granules and solid briquettes), and thus includes relatively high viscosity "gels" that may include suspended solids. The liquid detergent must, however, be capable of flowing from the detergent supply container 40 through the dispensing valve 12 into the receptacle 14 via the force of gravity. Preferably, the liquid detergent flows into and fills the receptacle 14 in a time period of from about 15 second to about 2 hours and, more preferably, of from about one minute to about 10 minutes.

It will be appreciated that other flowable non-liquid detergents (e.g., solid powder granules) could be used with the present dispensing system 10. It should also be appreciated that the present dispensing system 10 could also be used to dispense other suitable liquid or non-liquid materials besides detergent, all without departing from the present invention.

The present dispensing system 10 also includes a support plate 20, for connecting to and supporting the dispensing valve 12. The support plate 20 and dispensing valve 12 may be formed integrally as part of an interior surface of the dishwasher appliance, preferably the interior facing surface of the appliance door. Alternatively, the support plate 20 and/or the dispensing valve 12 may be separate components that are fastened to the interior surface of the dishwasher appliance.

As especially shown in FIGS. 2A and 2B, the receptacle 14 reciprocally slides along the support plate 20 between a fill position (FIG. 2A) and a dispensing position (FIG. 2B). Rails 22 define and limit the reciprocal movement of the receptacle 14 relative to the support plate 20.

When in the receptacle 14 is in the fill position (FIG. 2A), a first opening 21 in the support plate 20 provides a fluid connection from the detergent supply container 40 through the dispensing valve 12 to the receptacle 14 (see large arrow "A" showing flow pattern). The first opening 21 is preferably a hollow cylindrical passage through the support plate 20 that is aligned with the hollow cylindrical passage of the dispensing valve 12. As noted above, the force of gravity causes the liquid detergent to flow from the detergent supply container 40 through the fluid connection and into the receptacle 14. Thus, it is preferable for the fluid connection to be provided at a top portion of the receptacle 14 and a bottom portion of the detergent supply container 40 when the receptacle 14 is in the fill position.

When the receptacle 14 is in the dispensing position (FIG. 2B), a second opening 23 in the support plate provides a fluid connection from the receptacle 14 to the interior space of the dishwasher appliance (see large arrow "B" showing flow pattern). Water sprayed onto the dishware in the dishwasher appliance passes through the second opening 23 and makes contact with the liquid detergent in the receptacle 14, washing it out. The receptacle 14 includes a tail portion 25 that covers the first opening 21 through the support plate 20 and thus prevents liquid detergent from flowing (e.g., leaking) out of the detergent supply container 40 while liquid detergent is being dispensed from the receptacle 14. It will be appreciated that the arrangement of the first opening 21 relative to the second opening 23 is not critical, and that either may be above or below the other or that they may be side-by-side.

Preferably, the receptacle 14 is in the fill position (FIG. 2A) until the washer appliance begins its washing cycle. A typical residential dishwasher is operated once per day. Thus, even highly viscous, slow-flowing dishwasher detergent gels have sufficient time to flow from a detergent supply container 40 into the receptacle 14 between uses. When the washer appliance is activated, the wax motor is energized and the receptacle 14 is pushed to the dispensing position (FIG. 2B) for a period of time sufficient to allow all of the liquid detergent to be dispensed into the wash cycle. At the appropriate time, the wax motor is de-energized and the receptacle 14 is returned to the fill position (FIG. 2A).

Figure 3:
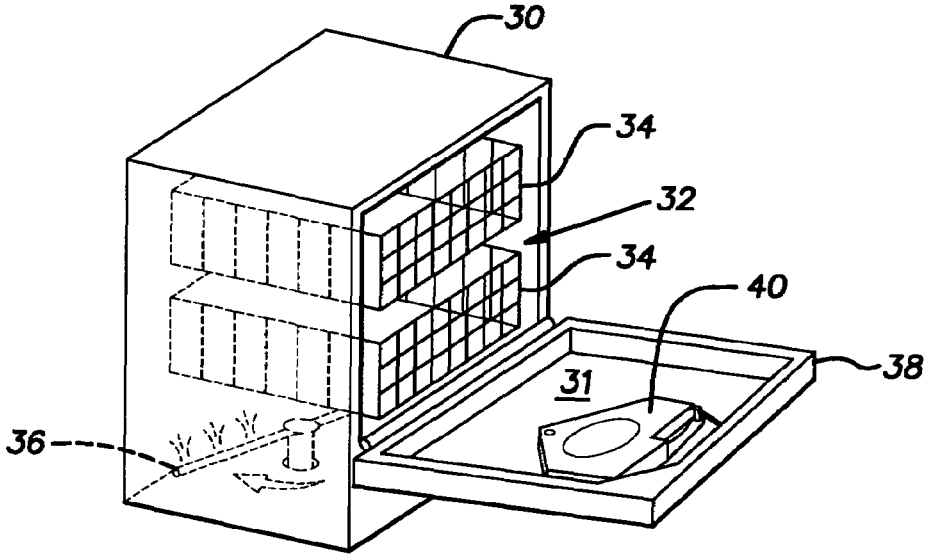
FIG. 3 is a perspective view generally showing a dishwasher incorporating a detergent dispenser in accordance with a preferred embodiment.

In the preferred embodiment, the dispenser system 10 is incorporated into a washer system, preferably a dishwasher 30, such as shown in FIG. 3. A dishwasher 30 includes an interior cabinet 32 for retaining a plurality of articles to be washed, preferably in one or more washer racks 34. A washer assembly 36, preferably a rotating sprayer or the like, is provided for directing wash water onto the plurality of articles. A cabinet door 38 is provided for enclosing the interior cabinet 32 and enabling the plurality of articles to be inserted and removed.

In the preferred embodiment, as indicated in FIGS. 2A and 2B, the present dispensing system 10 is incorporated into the cabinet door 38 of the dishwasher system 30. The dispensing system 10 is preferably configured so that the support plate 20 with the second opening 23 (also sometimes referred to as the "dispensing aperture") and the dispensing valve 12 are formed as part of or connected to an interior surface 31 of the dishwasher system 30, i.e. a surface of the door 38 facing the interior cabinet 32. The receptacle 14 and the motor 16 are mounted to a surface within the cabinet door 38, and are concealed from view by an exterior cabinet door surface 47.

As indicated in FIG. 3 and particularly shown in detail in FIGS. 4A, 4B, 5A, 5B, the dispensing valve 12 fluidly connects to a detergent supply container 40. The detergent supply container 40 is designed to fit within a recess or other suitable area on an interior side of the cabinet door 38 of the dishwasher. The detergent supply container 40 is preferably an "off-the-shelf" disposable container of detergent that can be purchased from a supermarket or other suitable retail establishment. Alternatively, the detergent supply container 40 can be a refillable container that is either permanently or removably mounted to the cabinet door 38. Preferably, the detergent supply container 40 includes a clear gradient stripe or other means that facilitates visual determination of the quantity of detergent remaining in the container 40.

Figure 4A:
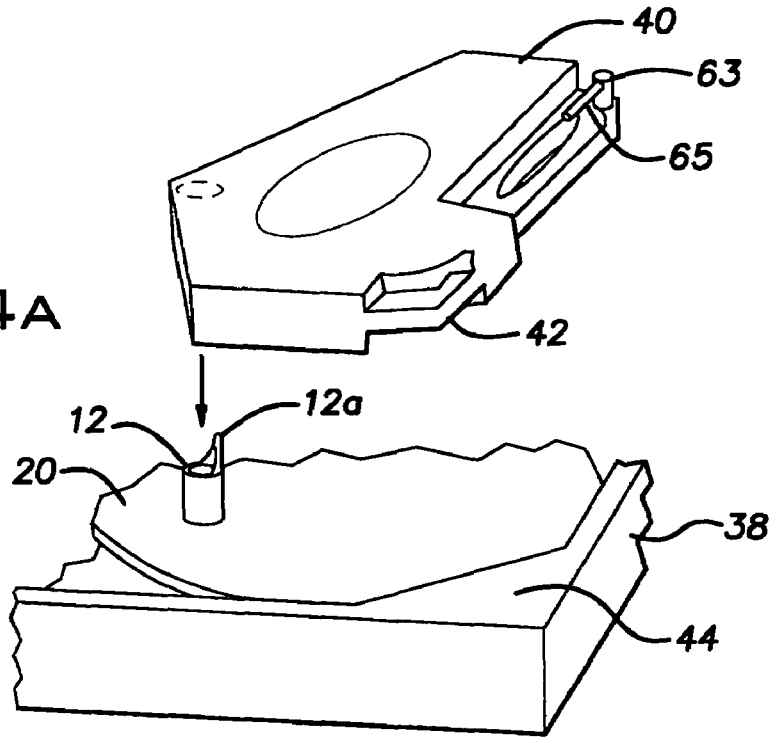
FIGS. 4A and 4B are views respectively showing an attachment configuration for the detergent dispenser in accordance with a first preferred embodiment.
Figure 5A:
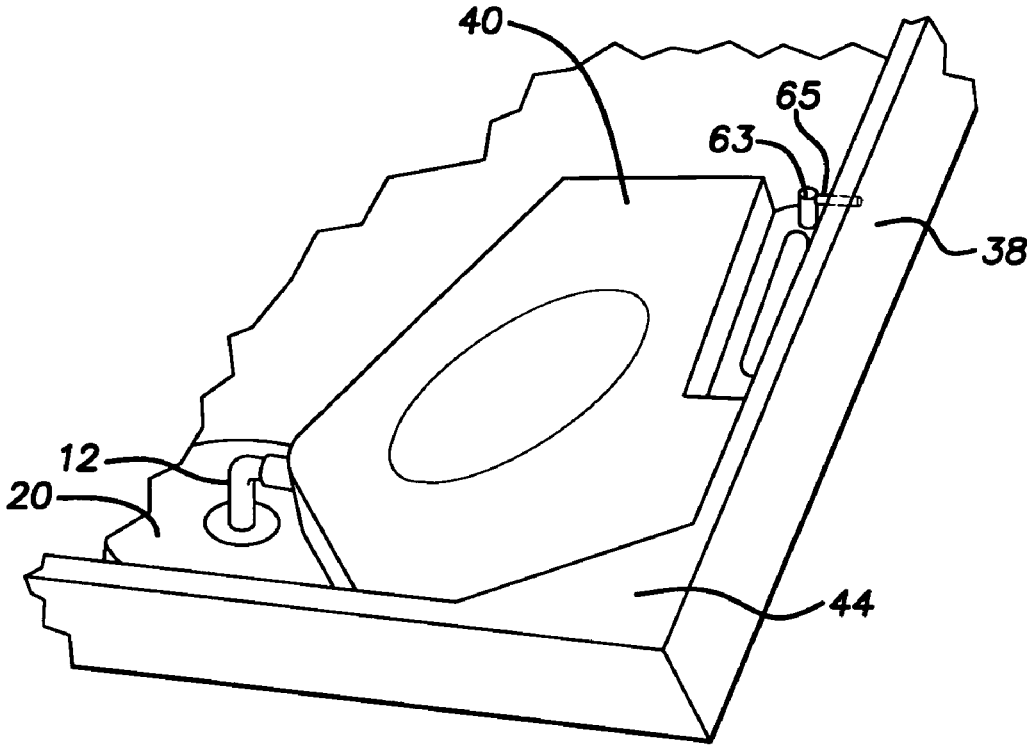
FIGS. 5A and 5B are views respectively showing an attachment configuration for the detergent dispenser in accordance with a second preferred embodiment.

As shown in FIGS. 4A and 5A, the detergent supply container 40 can include a stabilizing heel 42, which may be a narrow tab formed onto a corner of the container 40. The stabilizing heel 42 is received under a ledge 44 formed in the corner of the cabinet door 38. In this manner, the stabilizing heel 42 securely retains the detergent container 40 against the cabinet door 38.

The detergent supply container 40 also includes a docking port 50 for dispensing detergent. In the preferred embodiment, the docking port 50 is penetrated by the dispensing valve 12 to permit the flow of detergent from the detergent supply container 40 through the dispensing valve 12 into the receptacle 14. In the most preferred embodiment of the invention, the docking port 50 is a polymeric membrane formed in a lower side corner of the container 40 that is pierced or penetrated by the valve 12, yet seals around the valve 12. This type of docking port 50 is preferred for use with disposable non-refillable detergent supply containers 40.

Figure 4B:
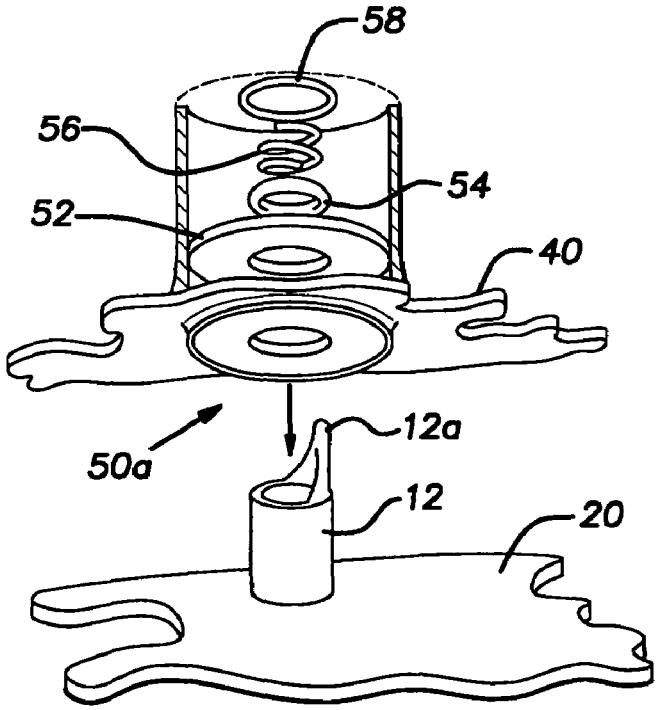

An alternative embodiment of a docking port 50 is shown in FIG. 4B. In this embodiment, the dispensing valve 12 includes a probe 12*a* formed on the tip of the valve 12. The docking port 50*a* comprises a biased seal, preferably of the type sold under the trade name "SAFEGARD" by Blackhawk Molding Co., Inc. of Addison, Ill. A biased seal of this type includes a foam liner 52, which is penetrated by the probe 12*a* upon initially installing the container 40 to the door 38. The probe 12*a* engages an inner cap 54 to displace the cap 54 toward an open position where detergent is discharged through a seal aperture 58 into the dispensing valve 12. The inner cap 54 is biased with a spring 56 so as to urge the inner cap 54 toward a closed position against the foam liner 52, and thereby block the opening of the docking port 50*a*. This type of docking port is preferred for use with refillable non-disposable detergent supply containers 40.

Figure 5B:
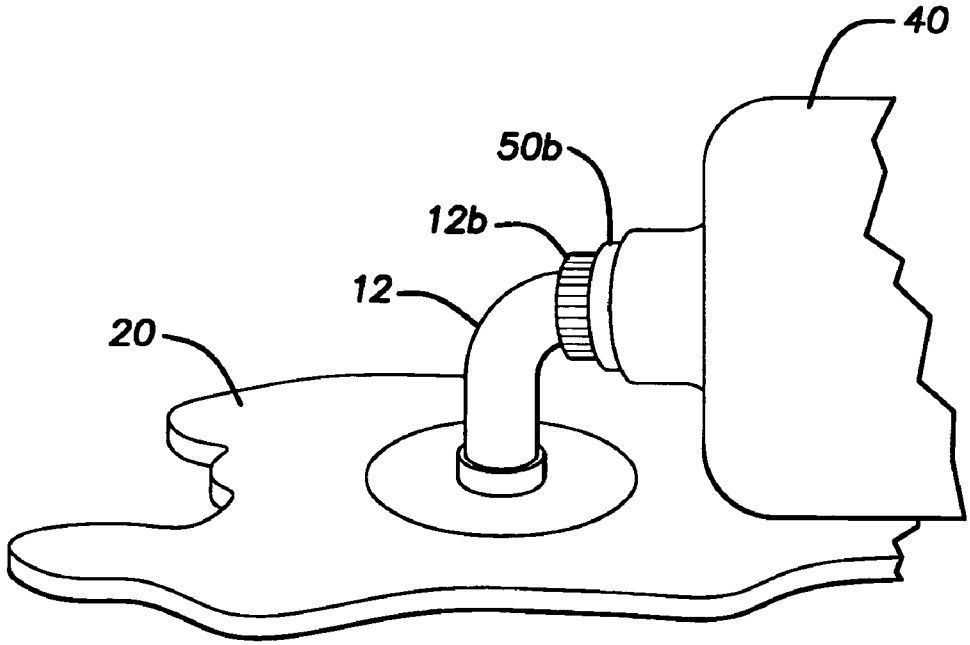

In a yet another embodiment, as is shown in FIG. 5B, the docking port 50*b* comprises a cap structure attached to the container 40. The dispensing valve 12, which may be shaped as a curved elbow, couples to a cap-type docking port 50*b* when the detergent supply container 40 is placed in position. The dispensing valve 12 includes a cap 12*b* that couples to the cap-type docking port 50*b* to dispense detergent. This arrangement of a docking port can be used with either refillable or non-refillable detergent supply containers 40.

Because the detergent supply container 40 is inside the dishwasher during the wash cycle, it is exposed to temperatures ranging from ambient to about 180° F. Any air within the detergent supply container 40 would expand as the temperature increases and contract as the temperature decreases. Thus, it is important that the detergent supply container 40 is either free of air (i.e., a collapsible bag-type container) or adequately two-way vented in order to avoid pressure build-ups.

FIGS. 2A, 2B, 4A and 5A show a screw-on breather cap 63 that includes openings that become aligned to form an air vent when the cap 63 is rotated from a closed position (FIG. 4A) to an open position (FIG. 5A). The breather cap 63 preferably further comprises an engagement lever 65 that is received within a slot formed in the cabinet door 38 when the cap 63 is rotated from the closed position to the open position to help retain the detergent supply container 40 on the cabinet door 38. Air can vent through the aligned openings within the breather cap 63 to equilibrate the pressure in the detergent supply container 40 in response to temperature changes. The air vent is preferably located on a top portion of the detergent supply container 40 opposite from docking port 50. It will be appreciated that other venting means (e.g., such as are used to vent fuel containers and the like) can also be used.

Thus, in the preferred embodiment of the invention, a detergent supply container 40 is mounted to the inner side of a dishwasher cabinet door 38 by first positioning the stabilizing heel 42 under the ledge 44 formed in the cabinet door 38. Next, the detergent supply container 40 is pressed onto the valve 12 such that the valve 12 pierces the docking port 50 membrane, creating a fluid connection for detergent to flow from the detergent supply container 40 through the valve 12 to the receptacle 14. The breather cap 63 is then rotated from the closed position (FIG. 4A) to the open position (FIG. 5A), with the engagement lever 65 being received within a slot formed in the cabinet door 38. The cabinet door 38 of the dishwasher is then closed and the dishwasher is turned on. Gravity causes detergent to flow from the detergent supply container 40 through the valve 12 and into the receptacle 14. At the appropriate time during the wash cycle, the dishwasher energizes the wax motor 16, causing it to push the receptacle from the fill position (FIG. 2A) to the dispensing position (FIG. 2B). Water from the washer assembly 36 washes the predetermined amount of detergent from the receptacle 14 into the dishwasher for use in cleaning the dishware therein. At the appropriate time during the wash cycle, the dishwasher de-energizes the wax motor 16, which thus withdraws the piston 18 and returns the receptacle 14 from the dispensing position (FIG. 2B) to the fill position (FIG. 2A). Detergent then flows from the detergent supply container 40 through the valve 12 and fills the receptacle 14 for the next operating cycle.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A washer system comprising:

an interior cabinet for retaining a plurality of articles to be washed;

a washer assembly for directing wash water onto the plurality of articles;

a cabinet door for enclosing the interior cabinet and enabling the plurality of articles to be inserted and removed;

a detergent dispensing system comprising:

a dispensing valve for fluidly connecting to a detergent supply container;

a receptacle fluidly connected to the dispensing valve for receiying a predetermined quantity of detergent from the detergent supply container; and a wax motor for translationally slidably displacing the receptacle between a fill position, connected to the dispensing valve, and a dispensing position, where the detergent is dispensed from the receptacle;

wherein the detergent supply container comprises a docking port that is penetrated by the dispensing valve, so as to discharge the predetermined quantity of detergent into the receptacle; and a support plate affixed to an interior surface of the washer system, for connecting to the dispensing valve and including a fluid connection between the dispensing valve and the fill position of the receptacle.

2. A washer system comprising:

an interior cabinet for retaining a plurality of articles to be washed;

a washer assembly for directing wash water onto the plurality of articles;

a cabinet door for enclosing the interior cabinet and enabling the plurality of articles to be inserted and removed;

a detergent dispensing system comprising:

a dispensing valve for fluidly connecting to a detergent supply container;

a receptacle fluidly connected to the dispensing valve for receiving a predetermined quantity of detergent from the detergent supply contalner; and a wax motor for translationally slidably displacing the receptacle between a fill position, connected to the dispensing valve, and a dispensing position, where the detergent is dispensed from the receptacle;

wherein the detergent supply container comprises a docking port that is penetrated by the dispensing valve, so as to discharge the predetermined quantity of detergent into the receptacle; and a support plate affixed to an interior surface of the washer system, for connecting to the dispensing valve and including a fluid connection between the dispensing valve and the fill position of the receptacle;

wherein the interior surface of the washer system is an interior surface of the cabinet door.

3. A washer system comprising:

an interior cabinet for retaining a plurality of articles to be washed;

a washer assembly for directing wash water onto the plurality of a cabinet door for enclosing the interior cabinet and enabling the plurality of articles to be inserted and removed;

a detergent dispensing system comprising:

a dispensing valve for fluidly connecting to a detergent supply container;

a receptacle fluidly connected to the dispensing valve for receiving a predetermined quantity of detergent from the detergent supply container;

and a wax motor for translationally slidably displacing the receptacle between a fill position, connected to the dispensing valve, and a dispensing position, where the detergent is dispensed from the receptacle;

wherein the detergent supply container comprises a docking port that is penetrated by the dispensing valve, so as to discharge the predetermined quantity of detergent into the receptacle; and a support plate affixed to an interior surface of the washer system, for connecting to the dispensing valve and including a fluid connection between the dispensing valve and the fill position of the receptacle, wherein the support plate comprises a dispensing aperture for aligning with the receptacle when displaced to the dispensing position, so as to dispense detergent from the receptacle into the interior of the washer system.

* * * * *